US006940475B2

(12) United States Patent
Shiizaki et al.

(10) Patent No.: US 6,940,475 B2
(45) Date of Patent: Sep. 6, 2005

(54) METHOD FOR DRIVING PLASMA DISPLAY PANEL AND PLASMA DISPLAY DEVICE

(75) Inventors: Takashi Shiizaki, Kawasaki (JP); Hitoshi Hirakawa, Kawasaki (JP); Eiji Ito, Kawasaki (JP); Shinsuke Tanaka, Kawasaki (JP); Satoru Nishimura, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 322 days.

(21) Appl. No.: 10/404,112

(22) Filed: Apr. 2, 2003

(65) Prior Publication Data

US 2003/0201953 A1 Oct. 30, 2003

(30) Foreign Application Priority Data

Apr. 25, 2002 (JP) ..... 2002-124409
Dec. 26, 2002 (JP) ..... 2002-377216

(51) Int. Cl.[7] ..... G09G 3/28
(52) U.S. Cl. ..... 345/60; 345/66
(58) Field of Search ..... 345/55, 60, 61, 345/62, 63, 66, 68, 78, 79; 313/484, 485, 486; 315/169.3, 169.4

(56) References Cited

U.S. PATENT DOCUMENTS

| | | | | |
|---|---|---|---|---|
| 6,084,558 | A | 7/2000 | Setoguchi et al. | 345/60 |
| 6,104,361 | A | 8/2000 | Rutherford | 345/55 |
| 6,667,579 | B2 * | 12/2003 | Kanazawa et al. | 315/169.3 |
| 6,707,436 | B2 * | 3/2004 | Setoguchi et al. | 345/60 |
| 2002/0041161 | A1 * | 4/2002 | Setoguchi et al. | 315/169.1 |
| 2002/0050960 | A1 | 5/2002 | Setoguchi et al. | 345/60 |
| 2002/0053882 | A1 * | 5/2002 | Kanazawa et al. | 315/169.3 |
| 2002/0093291 | A1 * | 7/2002 | Kanazawa et al. | 315/169.4 |
| 2002/0135542 | A1 * | 9/2002 | Kim et al. | 345/50 |

FOREIGN PATENT DOCUMENTS

| | | |
|---|---|---|
| EP | 0 762 373 A2 | 3/1997 |
| EP | 0 903 719 A2 | 3/1999 |
| EP | 0 965 975 A1 | 12/1999 |
| EP | 1 065 650 A2 | 1/2001 |
| JP | 2801893 | 7/1998 |
| JP | 11-327505 | 11/1999 |
| JP | 2002-140033 | 5/2002 |

* cited by examiner

*Primary Examiner*—Vijay Shankar
*Assistant Examiner*—Nitin Patel
(74) *Attorney, Agent, or Firm*—Staas & Halsey LLP

(57) ABSTRACT

A driving method, able to realize a PDP device having a reduced background luminance and high display quality, has been disclosed. The driving method is a method for driving a plasma display panel consisting of plural display electrodes forming pairs of electrodes, plural address electrodes, and display cells formed at the intersections of the pairs of electrodes and the address electrodes, comprising an initialization period, an address period, a charge form period during which a charge form pulse is applied to the pair of electrodes, and a sustain discharge period during which a sustain discharge light emission is caused to occur, wherein the initialization period comprises a write period during which first amount of charges is accumulated in the display cells and a charge adjust period during which the amount of charges accumulated during the write period is adjusted to second amount of charges, and wherein the voltage to be applied to the pair of electrodes is an inclined wave-shaped charge adjust pulse, the voltage of which varies gradually and the absolute value of the voltage of the charge form pulse is greater than the absolute value of the voltage of the sustain discharge pulse.

13 Claims, 16 Drawing Sheets

METHOD FOR DRIVING PLASMA DISPLAY PANEL AND PLASMA DISPLAY DEVICE

BACKGROUND OF THE INVENTION

The present invention relates to a method for driving a plasma display panel (PDP) and a PDP device. More particularly, the present invention relates to a driving method that improves the display contrast of a PDP.

FIG. 1 is a diagram showing a basic configuration of a PDP device.

A plasma display panel (PDP) 1 is a device that performs display by causing a discharge to occur in a discharge space sandwiched by two glass substrates with a mixture of a neon gas, a xenon gas, etc., by applying a voltage greater than a discharge start voltage between electrodes formed on the substrate, and exciting phosphors, formed on the substrate, so that they emit light, using ultraviolet rays generated by the discharge. Although various configurations have been proposed for a PDP, a three-electrode surface discharge type panel, which is currently most widely put to use, is described as an example.

In the plasma display panel (PDP) 1, plural X electrodes 2 (sustain electrodes) and Y electrodes 3 (scan electrodes) are arranged adjacently by turns and address electrodes 4 (third electrodes) are arranged in the direction perpendicular to that in which the X electrodes and the Y electrodes extend. Between a pair of X electrode and Y electrode, that is, between X1 and Y1, between X2 and Y2, . . . , a display line is formed and a display cell 5 is formed at the crossing of each display line and the address electrode 4. The X electrodes and the Y electrodes are referred to as display electrodes.

The X electrodes are commonly connected to an X drive circuit 7 and the same drive signal is applied to them. The X drive circuit 7 is provided with a sustain pulse circuit 8 that generates a sustain pulse, which will be described later, and a voltage used for resetting and addressing, and a reset/address voltage generation circuit 9. The Y electrodes are connected individually to a scan circuit 11 provided within a Y drive circuit 10, and a scan pulse is applied sequentially to them during an address period, which will be described later. The Y drive circuit 10 is further provided with a sustain pulse circuit 12 that generates a sustain pulse and a reset/address voltage and a reset/address voltage generation circuit 13. The address electrodes are connected to the address driver 6 and an address signal to select a cell to be lit or not lit is applied to them during addressing in synchronization with the scan pulse.

As a discharge in a PDP takes only two values, that is, ON and OFF, gradation is displayed by varying the number of times of light emission. Therefore, a frame that corresponds to a display of a screen is divided into plural subfields. Each subfield is composed of an initialization period (reset period), an address period and a sustain discharge period (sustain period). During the initialization period, addressing is performed so that all the display cells are put into a uniform state in which, for example, wall charges are erased, or wall charges are formed uniformly, regardless of the lit or unlit state of the cells in the previous subfield. During the address period, a selective discharge (address discharge) is caused to occur so that the ON (lit) or OFF (unlit) state of a display cell is determined according to display data and the wall charges in a cell to be lit are put into a state different from that of a cell not to be lit. During the sustain discharge period, a discharge is caused to occur repeatedly in a display cell selected during the address period and light is emitted. If the number of sustain discharge pulses, that is, the period of the sustain discharge pulse, is constant, the length of a sustain discharge period differs from subfield to subfield, therefore gradation is expressed by setting the ratio of times of light emission in each subfield to, for example, 1:2:4:8: . . . , and combining subfields that emit light according to the gradation of each display cell.

FIG. 3 is a diagram that shows typical examples of drive waveforms of conventional PDP devices. As shown schematically, an initialization period TR is composed of a charge write period TR1 and a charge adjust period TR2. In the charge write period TR1, in a state in which 0V is being applied to the address electrode A, an inclined wave-shaped pulse, the voltage of which varies gradually from 0V to Vw, is applied to the Y electrode, and an inclined wave-shaped pulse, the voltage of which gradually varies from 0V to Vq, is applied to the X electrode. Due to this, a discharge is caused to occur everywhere regardless of the wall charges accumulated in the display cells, and negative wall charges are accumulated on the Y electrode and the positive charges, on the X electrode. During the charge adjust period TR2, a inclined wave-shaped pulse, the voltage of which varies gradually from Vw to Vry, is applied to the Y electrode and a voltage Vx is applied to the X electrode, therefore, the wall charges accumulated in the Y electrode and X electrode during the TR1 period decrease almost to zero. There may be some cases where a certain amount of charge, with which a discharge is not caused to occur even if a sustain discharge pulse is applied, is left on the Y electrode and X electrode.

During the address period TA, the voltage Vx is applied to the X electrode and, in a state in which 0V is being applied to the Y electrode, a scan pulse having the voltage Vy is applied sequentially to the Y electrode and an address voltage Va is applied to the address electrode A in a cell to be lit in synchronization with the application of the scan pulse. The voltage 0V is applied to the address electrode in a cell not to be lit. An address discharge is caused to occur in a cell to be lit to which the scan pulse and the address voltage have been applied, and positive wall charges are accumulated on the Y electrode and negative charges are accumulated on the X electrode. These wall charges on the Y electrode and X electrode are able to cause a sustain discharge to occur when a sustain discharge pulse is applied. As an address discharge is not caused to occur in a cell not to be lit, the amount of wall charges on the Y electrode and X electrode remains almost zero.

During the sustain discharge period TS, in a state in which 0V is being applied to the address electrode, a voltage Vs1 and the voltage 0V are applied alternately to the X electrode and Y electrode as a sustain discharge pulse. In a cell to be lit, the voltage due to wall charges is added to the voltage of the sustain discharge pulse, the discharge start voltage is exceeded, a sustain discharge is caused to occur, and the charges move and an amount of charges necessary for the next sustain discharge is accumulated on the Y electrode and X electrode. In other words, when the address period is completed, positive wall charges are accumulated on the Y electrode and negative wall charges are accumulated on the X electrode, that is, a voltage, the high potential side of which is the Y electrode, is being applied between the Y electrode and the X electrode. Therefore, if the voltage Vs1 is applied to the Y electrode and 0V is applied to the X electrode as a sustain discharge pulse at the inception of the sustain discharge period, the voltage due to the above-mentioned wall charges are added, the discharge start voltage is exceeded, and a sustain discharge is caused to occur.

When a sustain discharge is caused to occur, the positive charges move from the Y electrode to the X electrode and accumulate thereon, the negative charges move from the X electrode to the Y electrode and accumulate thereon, and the sustain discharge is terminated because a voltage, the high potential side of which is the X electrode, is produced. Then, if 0V applied to the Y electrode and a voltage Vs is applied to the X electrode as a sustain discharge pulse, a sustain discharge is caused to occur because the voltage due to the wall charges, the high potential side of which is the X electrode, is added. This cycle is repeated during the sustain discharge period. As no charge is accumulated in a cell not to be lit, no discharge is caused to occur even though a sustain discharge pulse is applied to either electrode.

FIG. 4 is a diagram that shows other examples of drive waveforms of conventional PDP devices. These examples differ from those in FIG. 3 in that a sustain discharge pulse is composed of positive pulses and negative pulses, the absolute value of voltage of which is Vs, that the final voltage of an inclined wave-shaped pulse to be applied to the X electrode during TR1 is −Vs, and that the voltage of the scan pulse is −Vs. The operations are almost the same as the examples in FIG. 3. In the examples in FIG. 4, the number of power sources can be reduced because the voltage Vs is used commonly, therefore, the advantage that the cost will be reduced can be gained. In the examples in FIG. 4, Vs is 70 to 90V, Vw, 150 to 200V, Vx, 110 to 140V, Vry, −Vs to (−Vs+20V), and Va, 50 to 70V.

The typical conventional PDP devices are described above, but there are various kinds of methods for driving PDP devices. For example, in Japanese Patent No 2801893, an ALIS method PDP device, in which the number of display lines can be doubled while the number of display electrodes remains the same as before by utilizing every gap between adjacent X electrodes and Y electrodes as a display line, has been disclosed. As the PDP device is widely known, a detailed description is not given here.

An address method performed during the above-mentioned address period includes a write address method and an erase address method. The write address method is a method in which wall charges necessary for a sustain discharge are formed by causing an address discharge to occur in a cell to be lit during the address period, and the drive methods shown in FIG. 3 and FIG. 4 employ the write address method. The write address method includes a case where wall charges are decreased to zero during the initialization period and another case where a certain amount of wall charge is left. If the wall charges are decreased to zero, the margin where light is not emitted in a cell not to be lit during the sustain discharge period becomes the largest, but problems occur such as that the voltage of the scan pulse needs to be raised because it is more unlikely that an address discharge is caused to occur. On the other hand, when a certain amount of wall charge is left, advantages are gained such as that the voltage of a scan pulse can be lowered, but the margin where light is not emitted in a cell not to be lit during the sustain discharge period becomes small.

Either way, in the conventional write address method, it is necessary to form wall charges while applying a scan pulse and, therefore, the width of the scan pulse needs to be lengthened to a certain extent, resulting in a problem that the address period is lengthened accordingly.

On the other hand, the erase address method is a method in which wall charges are formed in all of the display cells during the initialization period and the wall charges in a cell not to be lit are erased and those in a cell to be lit are left during the address period. In this method also, there are two cases where the wall charges in a cell not to be lit are erased completely and where a certain amount of wall charges is left, and this method has both advantages and disadvantages as a write address method.

Japanese Patent Application No. 2000-336248 (Japanese Unexamined Patent Publication (Kokai) No. 2002-140033: disclosed May 17, 2002) has disclosed an erase address method, in which an erase period during which wall charges in a cell not to be lit are erased and a write period during which wall charges necessary for a sustain discharge are formed in a cell to be lit are provided, after the wall charges in the cell not to be lit are erased to a certain extent during the select period.

Moreover, Japanese Unexamined Patent Publication (Kokai) No. 11-327505 has disclosed a structure, in which charges in a cell to be lit are adjusted after an address period, in an ALIS method PDP disclosed in the above-mentioned Japanese Patent No. 2801893.

The present invention relates to a write address method.

One of the factors that determine the picture quality of a display device is contrast, and what deteriorates the contrast most is a background light emission in an unlit state. A light emission caused by a discharge during the initialization period TR is a light emission that has no relationship with display data and can be a factor to deteriorate the contrast and the picture quality.

There can be thought two ways which will reduce the intensity of a light emission caused by a discharge during the initialization period TR, as follows:

(1) The application voltage during the charge write period TR1 is reduced; or (2) The slope with which the voltage varies during the charge write period TR1 or the charge adjust period TR2 is made to be more gradual.

However, the step (1) brings a problem that an initialization malfunction, in which no discharge is caused to occur in some display cells depending on the previous display state, is brought about and the margin of operation may be deteriorated. The step (2) brings a problem that the drive time is protracted. Therefore, the above-mentioned steps (1) and (2) are limited in reducing the background light emission.

In the conventional drive methods shown in FIG. 3 and FIG. 4, the voltage to be applied between the X electrode and the Y electrode during the charge adjust period TR2 is made to be almost equal to or slightly less than the voltage to be applied between the X electrode and the Y electrode during the address period TA. This is because a problem occurs that an erroneous discharge is caused to occur in a cell not to be lit when the voltage to be applied between the X electrode and the Y electrode during TR2 is much less than the voltage to be applied between the X electrode and the Y electrode during TA, and when, contrary to this, the former voltage is much greater than the latter one, another problem occurs that a wasteful background light emission is caused to occur during TR2. Moreover, as it is necessary to accumulate an amount of charge sufficient to cause a discharge to occur in a cell to be lit by applying a sustain discharge pulse during the address period TA, the voltage to be applied between the X electrode and the Y electrode needs to be increased. However, if the voltage to be applied between the X electrode and the Y electrode is increased during the address period TA, it is also necessary to increase the application voltage during the charge adjust period TR2 because of the above-mentioned reasons, therefore, the background light emission cannot be reduced during TR2. Therefore, a new drive method that can reduce the background light emission and improve contrast is required.

SUMMARY OF THE INVENTION

The objective of the present invention is to realize a method for driving a PDP employing a new write method in which the contrast has been improved.

In order to achieve the above-mentioned objective, in the method for driving a plasma display panel and the plasma display device of the present invention, the background light emission is reduced by employing an inclined wave-shaped pulse the application voltage of which varies gradually as a charge adjust pulse to be applied to a pair of electrodes during a charge adjust period and by lowering the final voltage of the charge adjust pulse to be applied to the pair of electrodes and the voltage to be applied between the display electrodes (X electrode and Y electrode) during the address period. However, if the final voltage of the charge adjust pulse and the voltage applied between the display electrodes during the address period are lowered, it is impossible to accumulate an amount of charges in a cell to be lit, with which a discharge is caused to occur by the application of a sustain discharge pulse, therefore, in the present invention, a charge form period is provided after the address period, in which a charge form pulse is applied, the absolute value of voltage of which is greater than that of the sustain discharge pulse and, thereby, an amount of charges enough to cause a sustain discharge to occur is formed. In this way, a normal sustain discharge can be caused to occur even if the voltage applied between the display electrodes during the charge adjust period and the address period is reduced and the background light emission is reduced, resulting in improvement in the contrast.

To describe the above more qualitatively, in the method for driving a plasma display panel and the plasma display device of the present invention, a certain amount of charge, with which a discharge is not caused to occur by a sustain discharge pulse, is uniformly accumulated during the initialization period, an address discharge is caused to occur in a display cell to be lit so that the amount of charges is decreased or charges of opposite polarity are accumulated during the address period, and a charge form pulse, which causes a discharge to occur in a cell to be lit but does not cause a discharge to occur in a cell not to be lit, is applied so that charges necessary for a sustain discharge are accumulated in the cell to be lit during the charge form period. As it is necessary to apply the charge form pulse only once, it is possible to adjust the voltage according to the polarity of the charges accumulated in the cells to be lit and not to be lit when the address period is completed. Therefore, it is possible to increase the absolute value of voltage of the charge form pulse so as to be greater than that of the sustain discharge pulse and to configure the settings so as to satisfy the requirement that a discharge is caused to occur in a cell to be lit but no discharge is caused to occur in a cell not to be lit.

In other words, the method for driving a plasma display panel of the present invention is a write address method in which a certain amount of charge is left by initialization and a sustain discharge is enabled by applying a charge form pulse having a polarity opposite to that of the voltage between the display electrodes due to the charges left by initialization and by increasing the amount of charges in a cell to be lit by a discharge.

BRIEF DESCRIPTION OF THE DRAWINGS

The features and advantages of the invention will be more clearly understood from the following description taken in conjunction with the accompanying drawings in which.

DESCRIPTION OF THE PREFERRED EMBODIMENTS

Figure 1:
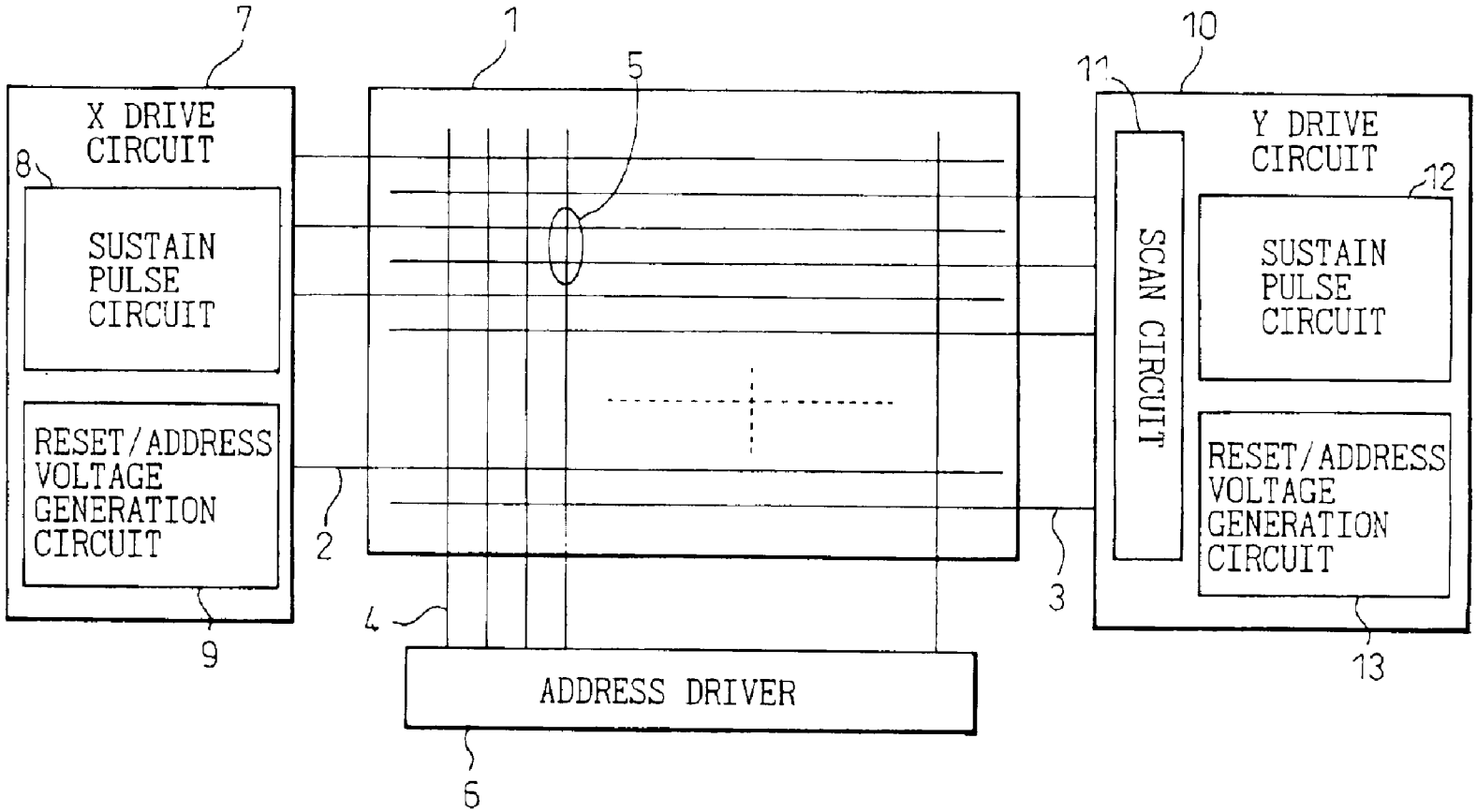
FIG. 1 is a general block diagram of a plasma display (PDP) device.
Figure 2:
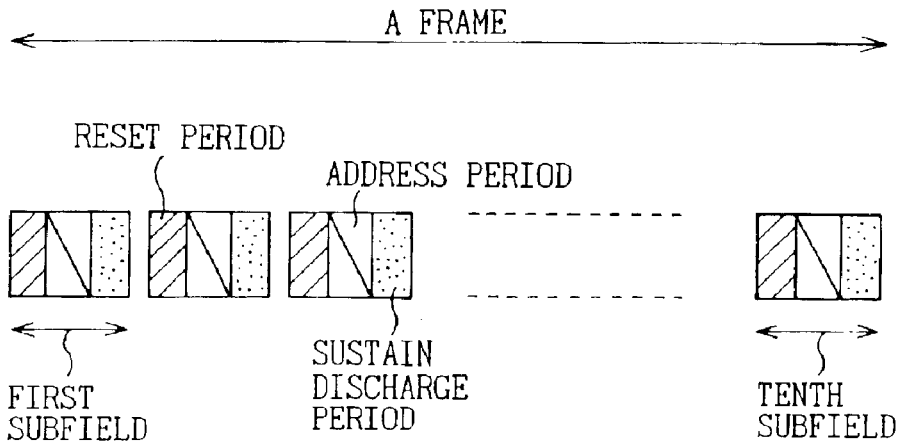
FIG. 2 is a diagram that shows a frame structure according to a subfield method.
Figure 3:
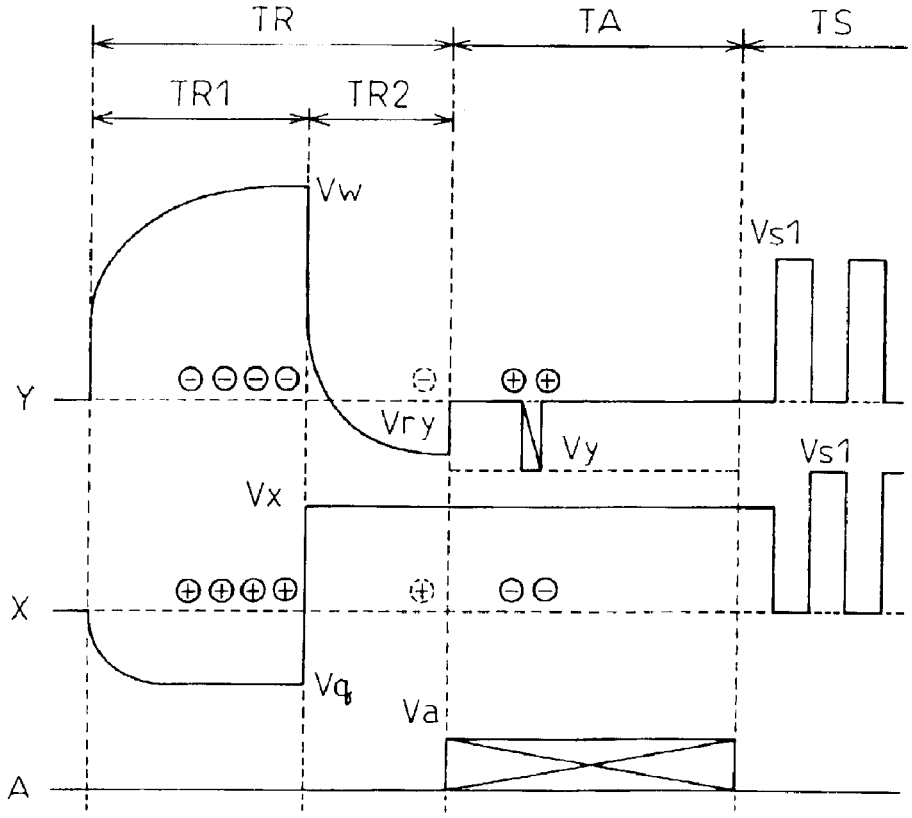
FIG. 3 is a diagram that shows examples of conventional drive waveforms.

The plasma display device in the first embodiment of the present invention has a structure similar to the conventional one shown in FIG. 1 but the drive method is different.

Figure 5:
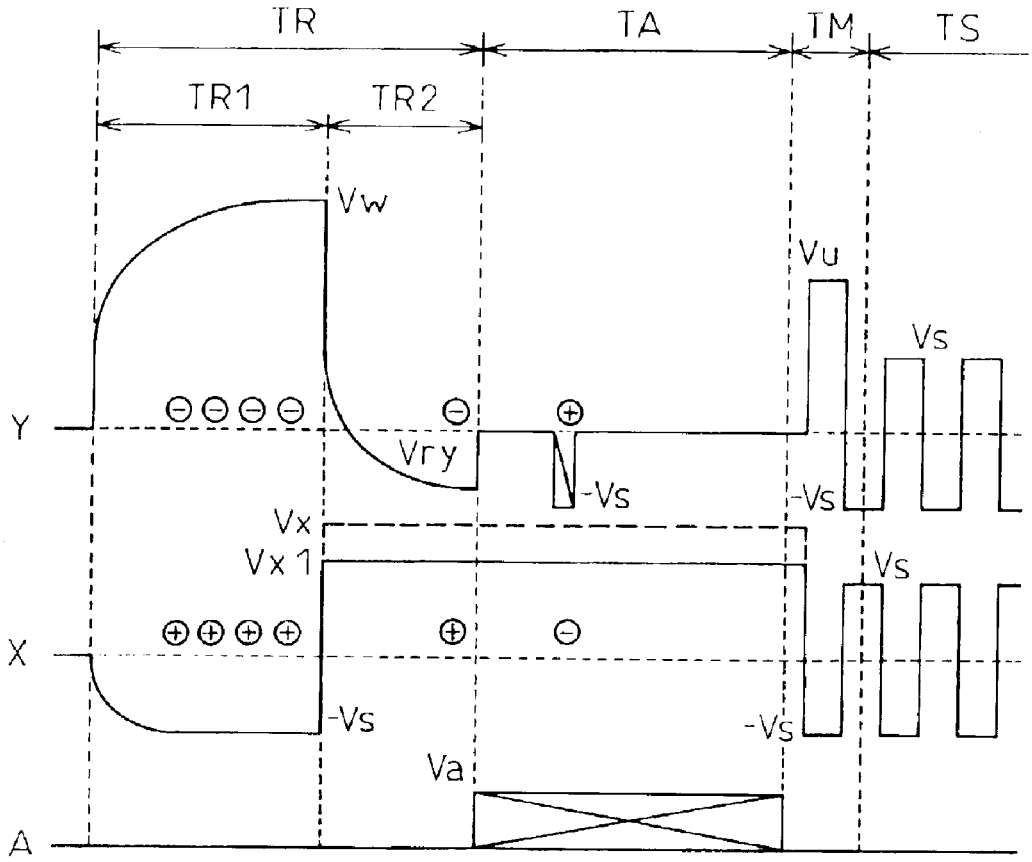
FIG. 5 is a diagram that shows drive waveforms in a PDP device in a first embodiment of the present invention.
Figure 6A:
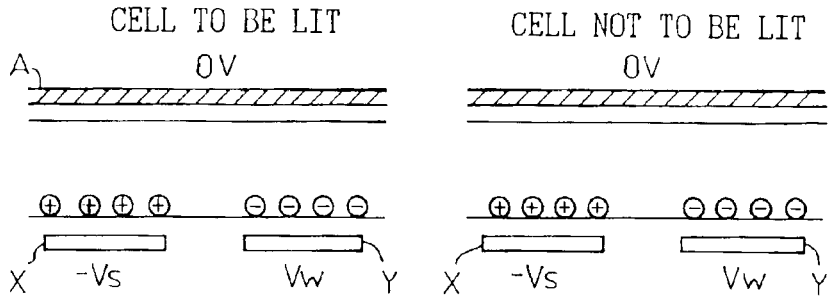
FIG. 6A to FIG. 6F are diagrams that show changes of the state of charges on electrodes in the PDP device in the first embodiment of the present invention.

FIG. 5 is a diagram that shows the drive waveforms in the first embodiment. FIG. 6A to FIG. 6F are diagrams that show the changes of the state of charges accumulated on the electrodes in the first embodiment. The drive waveforms in FIG. 5 are described with reference to FIG. 6A to FIG. 6F. In the charge write period TR1, the first half of the initialization period TR, in a state in which 0V is being applied to the address electrode A, an inclined wave-shaped pulse, the voltage of which varies gradually from 0V to Vw (150 to 200V), is applied to the Y electrode and an inclined wave-shaped pulse, the voltage of which varies gradually from 0V to −Vs (−70 to −90V), is applied to the X electrode. Due to this, a discharge is caused to occur everywhere regardless of the wall charged accumulated in a display cell, and negative wall charges are accumulated on the X electrode and positive wall charges are accumulated on the Y electrode, as shown in FIG. 6A.

Figure 6B:
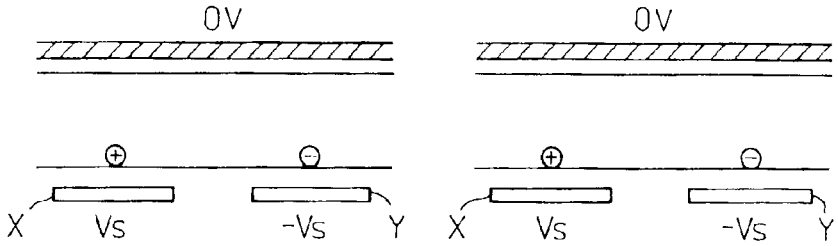

In the charge adjust period TR2, the second half of the initialization period TR, an inclined wave-shaped pulse, the voltage of which varies gradually from Vw to Vry (−Vs to (−Vs+20V)), is applied to the Y electrode and a voltage Vx1 (Vs to (Vs+20V)) is applied to the X electrode, therefore, the wall charges accumulated on the Y electrode and the X electrode during TR1 are decreased and adjusted so that a fixed amount of negative wall charge is left on the Y electrode and a fixed amount of positive wall charge is left on the X electrode, as shown in FIG. 6B. The amount of the wall charge left on the Y electrode and the X electrode is an amount with which a discharge is not caused to occur even if a sustain discharge, which will be described later, is applied. Although the voltages are set so that Vx1−Vry=2Vs, there can be some variations of voltage as long as, for example, Vx1−Vry>2Vs is maintained. The case where Vx1−Vry<2Vs will be described in the fourth embodiment.

Figure 6C:
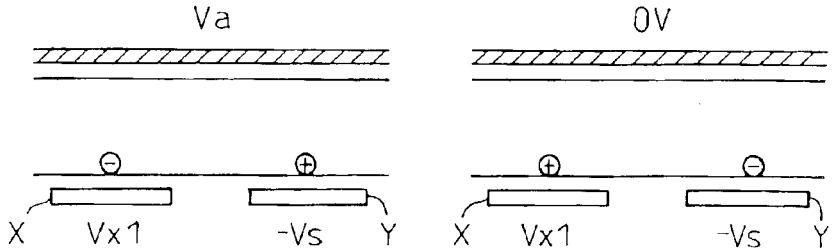
Figure 6D:
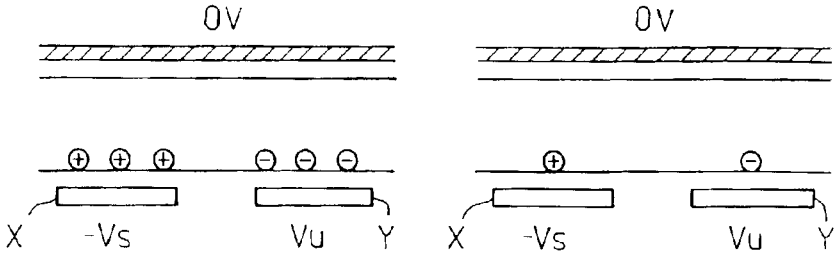

In the address period TA, in a state in which the voltage Vx1 is being applied to the X electrode and 0V is being applied to the Y electrode, a scan pulse of voltage of −Vs is sequentially applied to the Y electrode and an address voltage Va (50 to 70V) is applied to the address electrode A in a cell to be lit in synchronization with the application of the scan pulse. To the address electrode in a cell not to be lit, 0V is applied. In a cell to be lit, to which the scan pulse and the address voltage have been applied, an address discharge is caused to occur and the wall charges are decreased or charges of opposite polarity are accumulated and, as a result, positive wall charges are accumulated on the Y electrode and negative wall charges are accumulated on the X electrode, as shown in FIG. 6C. In this case, the amount of the wall charges on the Y electrode and the X electrode is an amount with which a sustain discharge is not caused to occur even if a sustain discharge pulse is applied. As an address discharge is not caused to occur in a cell not to be lit, the amount of wall charges accumulated on the Y electrode and the X electrode remains that which has been adjusted during the charge adjust period TR2. Therefore, there is a difference in voltage produced by the amount of charges that has been changed by an address discharge between a cell to be lit and one not to be lit.

During the charge form period TM, a voltage Vu (110 to 150V) greater than Vs is applied to the Y electrode and −Vs is applied to the X electrode. As a result, a voltage of 180 to 240V is applied between the Y electrode and the X electrode. When such a voltage is applied, the discharge start voltage is exceeded and a discharge is caused to occur, and more negative charges are accumulated on the Y electrode and more positive charges are accumulated on the X electrode in a cell to be lit. The amount of charges accumulated on the X electrode and the Y electrode at this time is an amount with which a discharge is caused to occur if a sustain discharge pulse is applied. On the other hand, there are negative charges on the Y electrode and positive charges on the X electrode in a cell to be lit, though slight in amount, which will serve in such a way that the voltage applied between the Y electrode and the X electrode is reduced because there are positive charges on the X electrode, therefore, a discharge is not caused to occur because the discharge start voltage is not exceeded and the amount of charge remains unchanged.

Figure 6E:
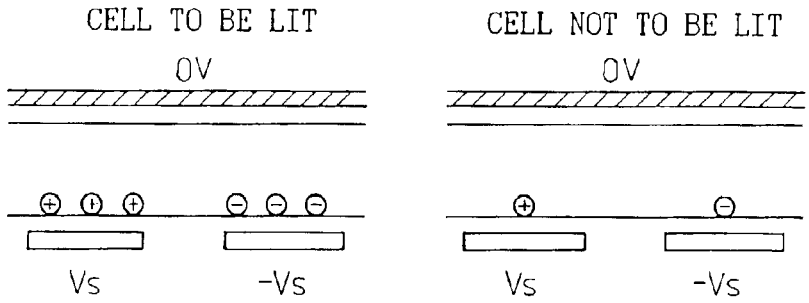
Figure 6F:
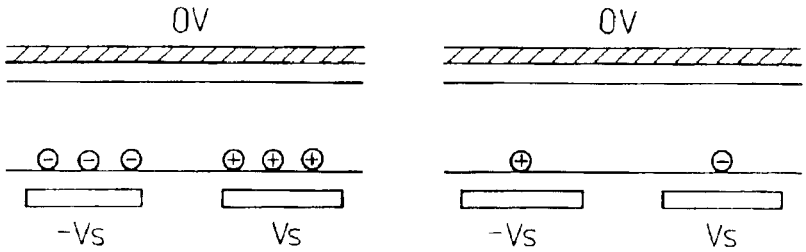

During the sustain discharge period Ts, in a state in which 0V is being applied to the address electrode, the voltages Vs and −Vs are applied alternately to the X electrode and the Y electrode as a sustain discharge pulse. As a result, a voltage of 2Vs is applied alternately between the X electrode and the Y electrode. As shown in FIG. 6E and FIG. 6F, the voltage due to the wall charges is added to the voltage due to the sustain discharge pulse, the discharge start voltage is exceeded, and a sustain discharge is caused to occur in a cell to be lit. Therefore, the charges move and the amount of charge necessary for the next sustain discharge is accumulated on the Y electrode and the X electrode, resulting in a repetition of a sustain discharge. On the other hand, the wall charges accumulated in a cell not to be lit do not cause a discharge to occur even though a sustain discharge pulse of either polarity is applied, because the discharge start voltage is not exceeded.

Figure 4:
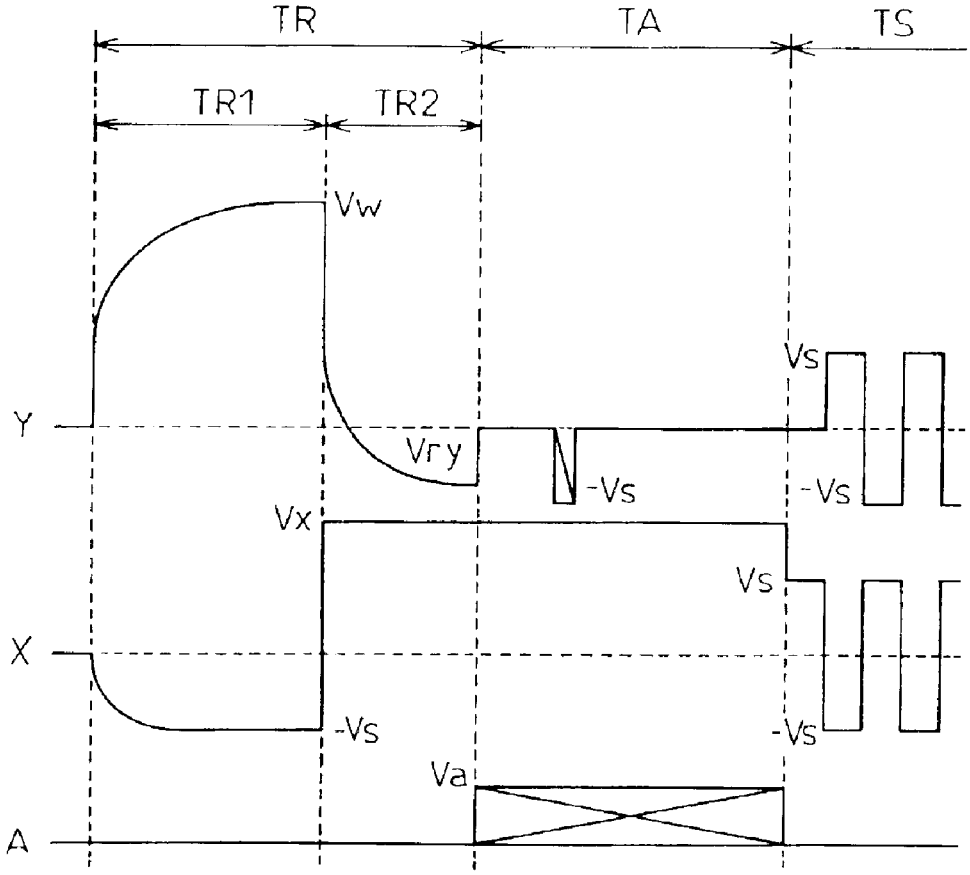
FIG. 4 is a diagram that shows other examples of conventional drive waveforms.

The drive waveforms and operations in the first embodiment are described as above. Next, the difference from conventional drive waveforms is described below with reference to FIG. 4. The waveforms in the present embodiment differ from the conventional ones shown in FIG. 4 in that the voltage to be applied to the X electrode during the charge adjust period TR2 and the address period is changed from Vx to Vxl, the voltage to be applied between the Y electrode and the X electrode is reduced, and the charge form period TM is provided. If the voltage to be applied to the X electrode during the address period is reduced, an amount of wall charge, with which a sustain discharge is caused to start when a sustain discharge pulse is applied, cannot be accumulated in a cell to be lit. However, in the present embodiment, as an amount of wall charges, with which a sustain discharge is caused to occur when a sustain discharge pulse is applied, is formed during the charge form period TM, it is not necessary to form such an amount of wall charges during the address period, therefore, the voltage to be applied to the X electrode during the address period can be reduced. In accordance with this, the voltage to be applied between the X electrode and the Y electrode during the charge adjust period TR2 can be reduced and the contrast is improved because the background light emission is reduced.

The first embodiment is described as above, but the described conditions of voltage are only examples. The present invention is not limited to the above and the voltage or the like should be adjusted according to the panel structure, etc. Even though the panel structure is the same, effects similar to those of the present invention can be achieved for a certain range of voltage.

Figure 7:
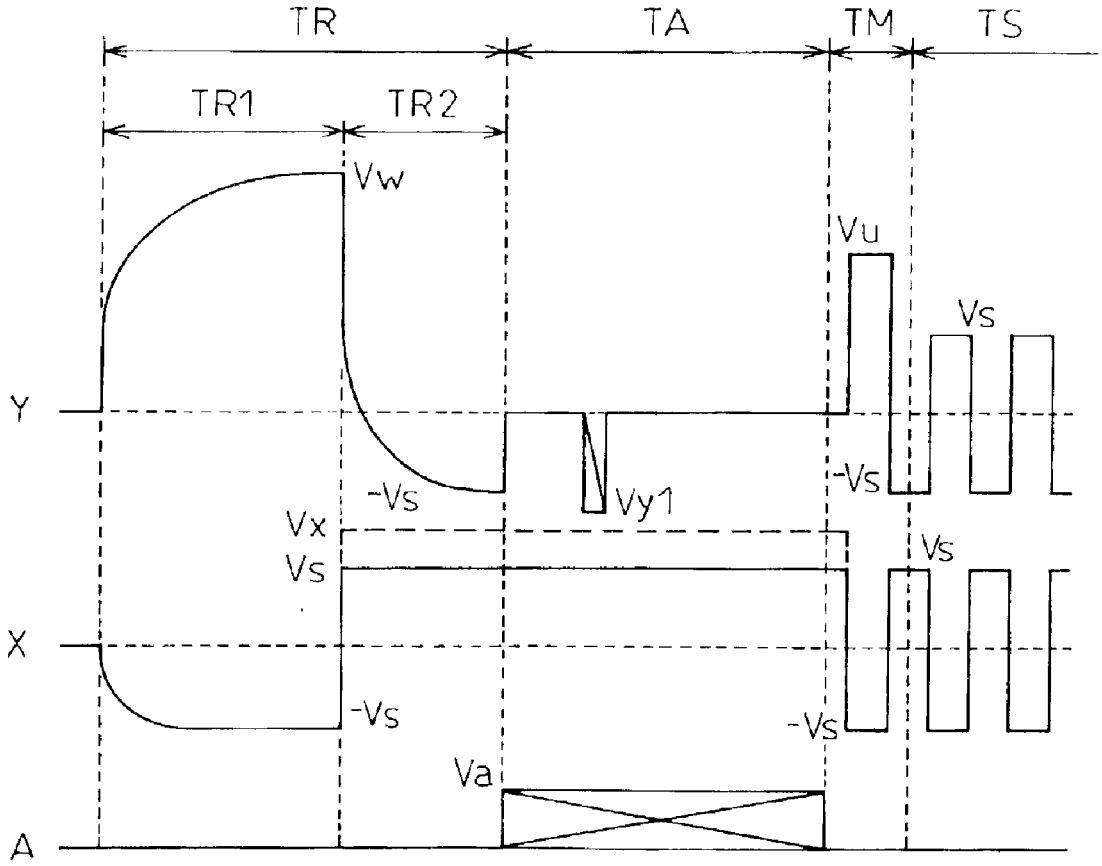
FIG. 7 is a diagram that shows drive waveforms in a PDP device in a second embodiment of the present invention.

The plasma display device in the second embodiment of the present invention has a structure similar to the conventional one shown in FIG. 1, similar to the first embodiment, but with a different drive method. FIG. 7 is a diagram that shows the drive waveforms in the second embodiment of the present invention. These drive waveforms differ from those in the first embodiment shown in FIG. 5 in that Vx1, Vry and the scan pulse voltage −Vs are replaced by Vs, −Vs and Vy1 (−Vs to (−Vs−20V), respectively. Such a structure can reduce the cost because the power source can be shared and the number of kinds of power source can be reduced.

Figure 8:
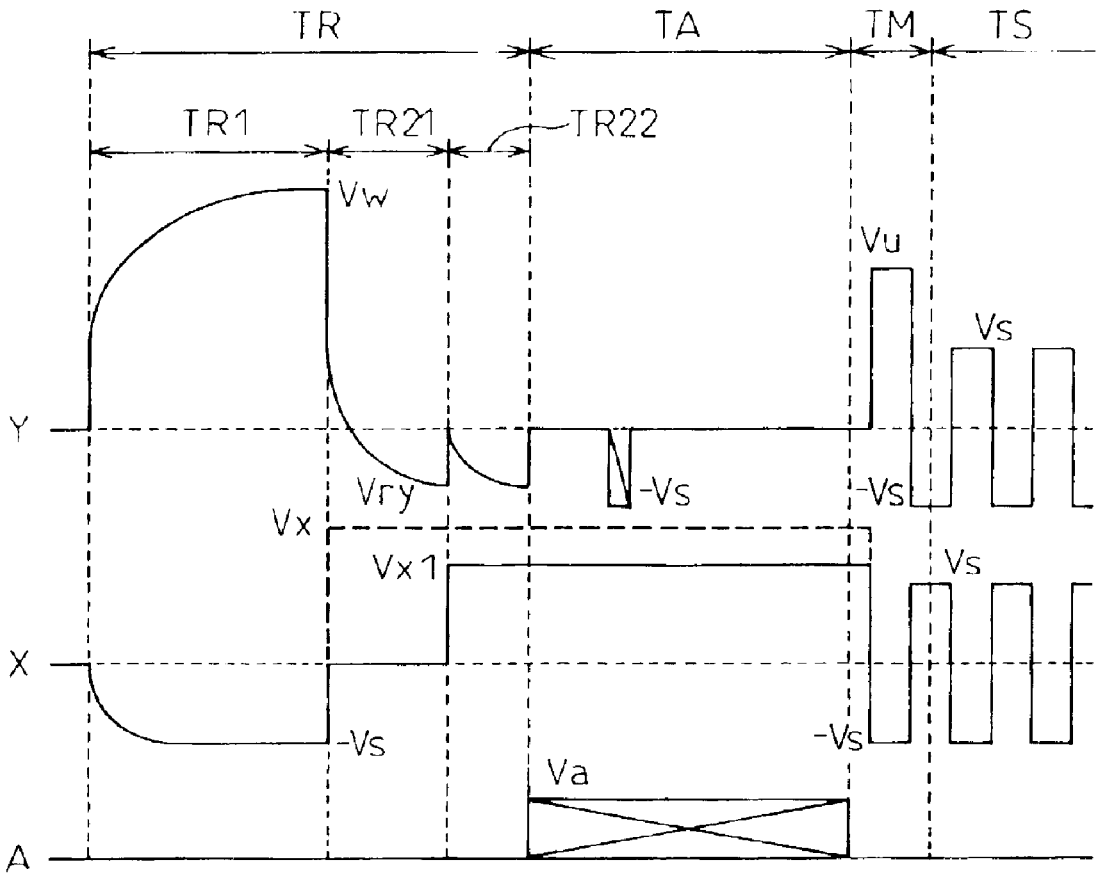
FIG. 8 is a diagram that shows drive waveforms in a PDP device in a third embodiment of the present invention.

The plasma display device in the third embodiment of the present invention has a structure similar to the conventional one shown in FIG. 1, similar to the first embodiment, but with a different drive method. FIG. 8 is a diagram that shows the drive waveforms in the third embodiment of the present invention. These drive waveforms differ from those in the first embodiment shown in FIG. 5 in that the charge adjust period TR2 is divided into TR21 and TR22. During TR21, while the voltage applied to the X electrode is being kept at 0V, the voltage applied to the Y electrode is gradually reduced from Vw to Vry. During TR22, while the voltage applied to the X electrode is being kept at Vx1, the voltage applied to the Y electrode is gradually reduced from 0V to Vry. By making the voltage applied to the X electrode during TR21 sufficiently less than the voltage applied to the X electrode during TR22, the charges between the address electrode and the Y electrode are adjusted during TR21 and those between the X electrode and the Y electrode are adjusted during TR22. In this way, by dividing the charge adjust period into two periods, during one the charges between the address electrode and the Y electrode are adjusted and during the other those between the X electrode and the Y electrode are adjusted, the charge adjustment can be performed more efficiently and the background light emission can be reduced.

Figure 9:
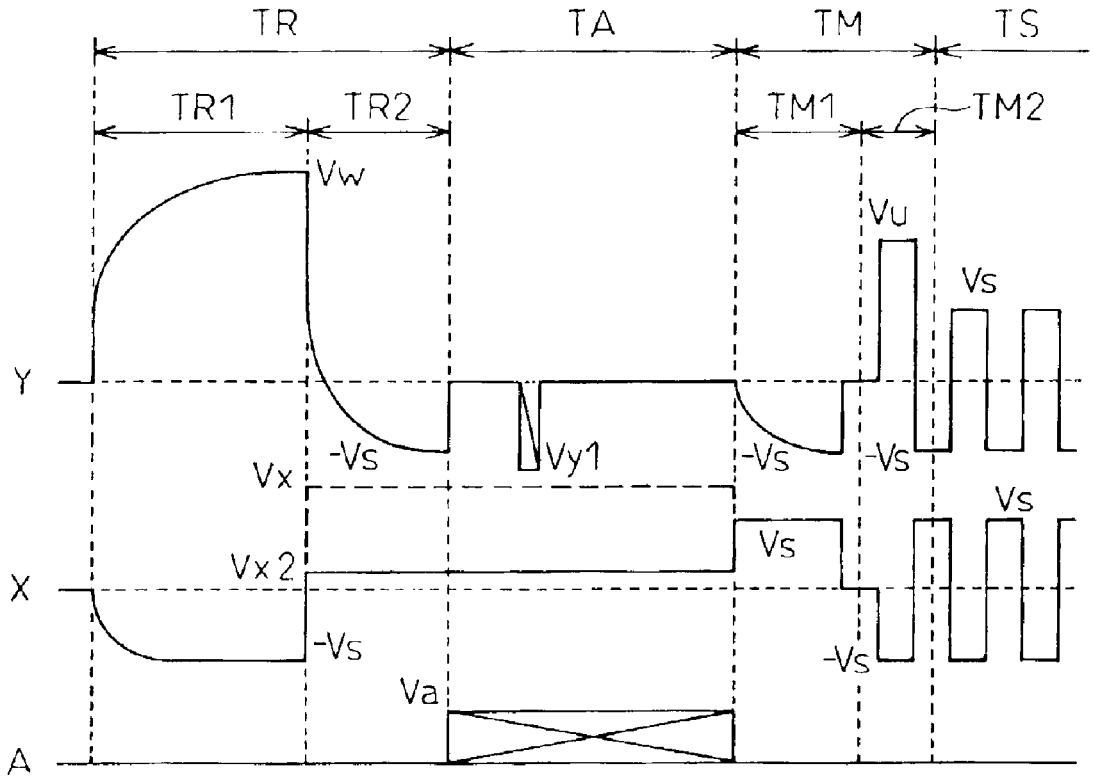
FIG. 9 is a diagram that shows drive waveforms in a PDP device in a fourth embodiment of the present invention.

The plasma display device in the fourth embodiment of the present invention has a structure similar to the conventional one shown in FIG. 1, similar to the first embodiment, but with a different drive method. FIG. 9 is a diagram that shows the drive waveforms in the fourth embodiment of the present invention. These drive waveforms differ from those in the second embodiment shown in FIG. 7 in that the voltage applied to the X electrode during the charge adjust period TR2 and the address period TA is set to Vx2 (0 to Vs), which is less than Vs, and that the charge form period TM is divided into TM1 and TM2. During TM1, in a state in which Vs is being applied to the X electrode, an inclined wave-shaped pulse, the voltage of which varies gradually from 0V to −Vs is applied to the Y electrode and during TM2, the voltage Vu is applied to the Y electrode and the voltage −Vs is applied to the X electrode, similar to the second embodiment. By setting the voltage applied to the X electrode during the charge adjust period TR2 and the address period TA to Vx2, which is less than Vs, it is possible to leave many charges during the address period TA because the amount of charges to be erased is reduced. If there exists a large amount of charge in the address period, a discharge is caused to occur more speedily during addressing and an address discharge with a higher degree of reliability can be realized. However, if the amount of charge in the address period is excessive, a sustain discharge is caused to occur even in a cell not to be lit, therefore, it is necessary to reduce the amount of charges in a cell not to be lit during the charge form period TM1.

The fifth embodiment of the present invention is an embodiment in which the present invention is applied to an ALIS method PDP device disclosed in Japanese Patent No. 2801893.

Figure 10:
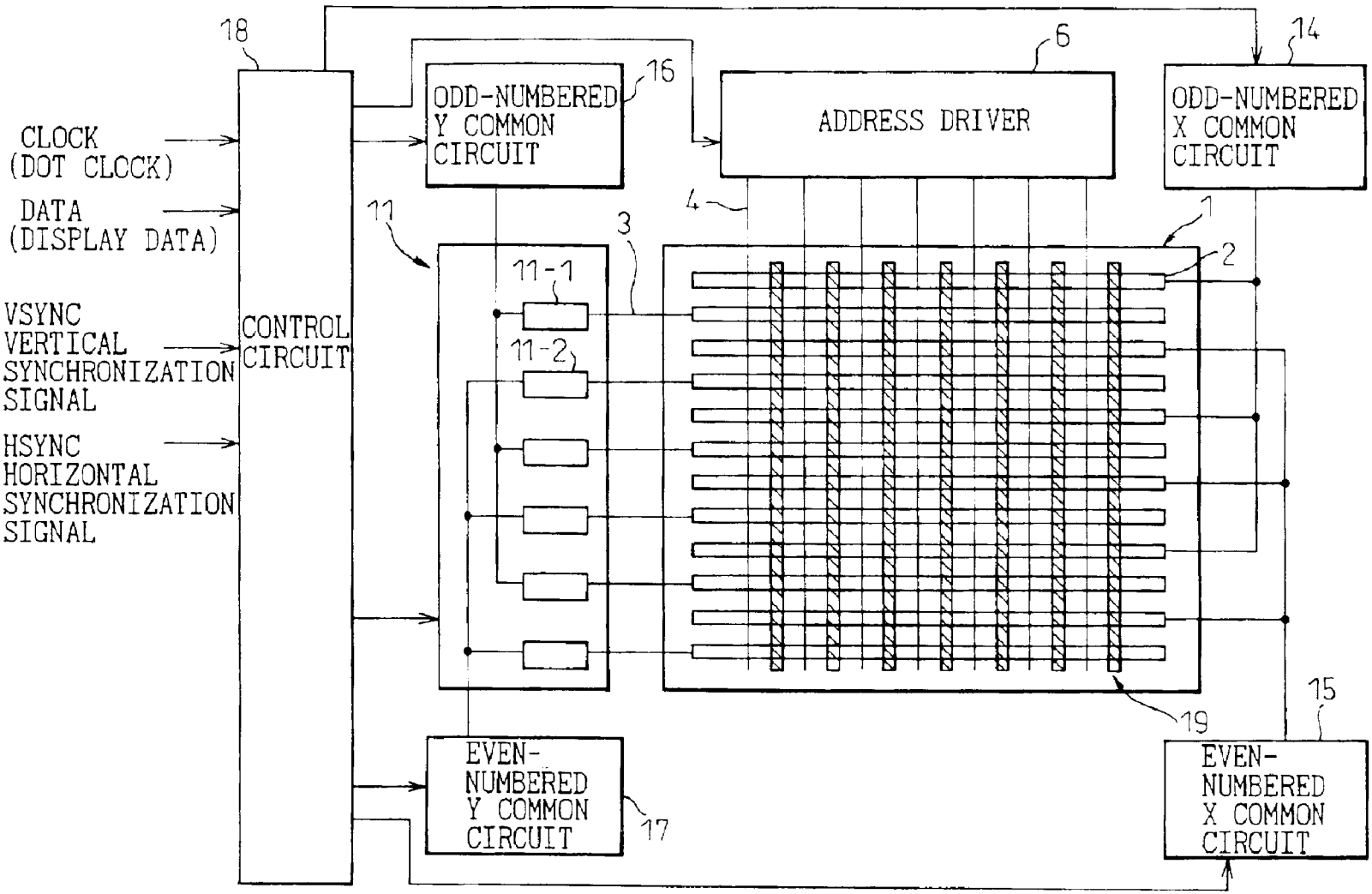
FIG. 10 is a block diagram of an ALIS method PDP device to which a fifth embodiment of the present invention is applied.

FIG. 10 is a block diagram that shows the general structure of the ALIS method PDP device disclosed in Japanese Patent No. 2801893. As shown schematically, the ALIS method PDP device comprises a panel 1 provided with X electrodes 2 and Y electrodes 3 making up sustain discharge electrodes and address electrodes 4, a control circuit 18, an address driver 6, a scan driver 11, an odd-numbered Y common circuit 16, an even-numbered Y common circuit 17, an odd-numbered X common circuit 14 and an even-numbered common circuit 15. Each common circuit is provided with a sustain pulse circuit and a reset/address voltage generation circuit shown in FIG. 1. As the configurations and operations of each device are disclosed in Japanese Patent No. 2801893, no detailed description is given here.

The ALIS method is characterized by an interlaced display in which a first display line is formed between a Y electrode and the neighboring X electrode located above it and a second display line is formed between a Y electrode and the neighboring X electrode located below it, and the first display lines are displayed in odd-numbered fields and the second display lines are displayed in even-numbered fields, whereby the number of display lines can be doubled compared to conventional ones, while the number of X electrodes and Y electrodes remains the same, and the resolution can be made to be finer.

Figure 11:
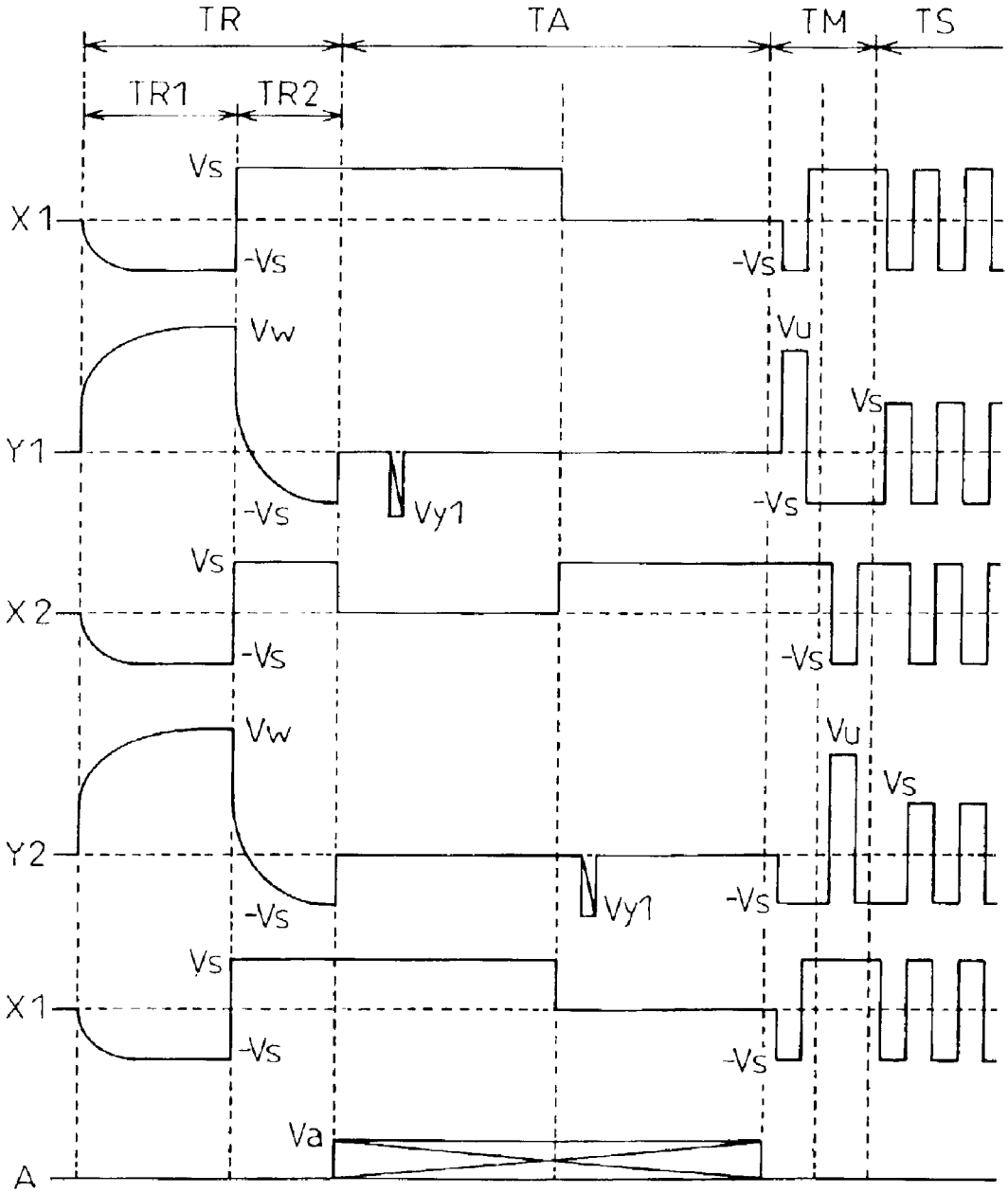
FIG. 11 is a diagram that shows drive waveforms in an odd-numbered field in the PDP device in the fifth embodiment.
Figure 12:
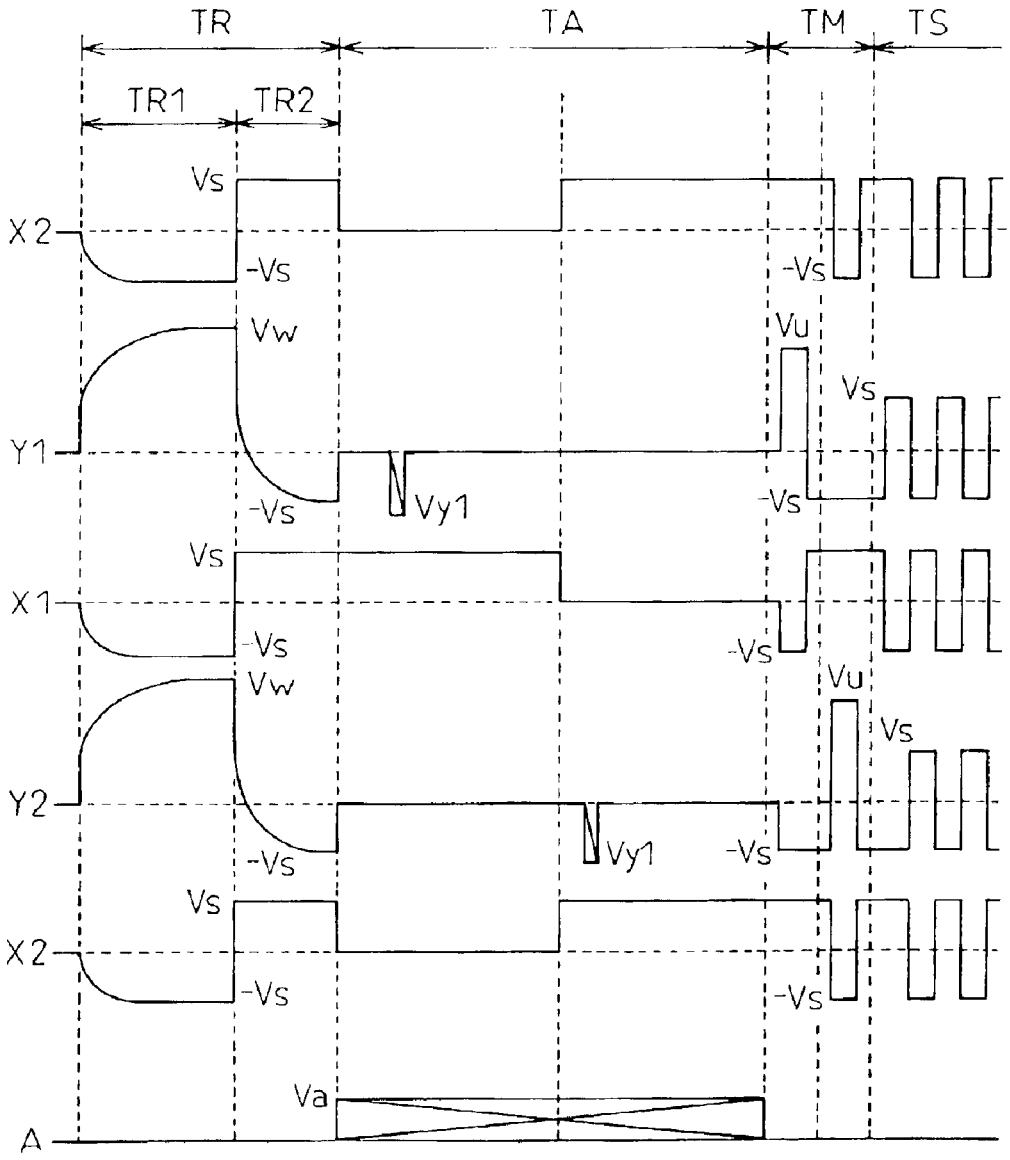
FIG. 12 is a diagram that shows drive waveforms in an even-numbered field in the PDP device in the fifth embodiment.

FIG. 11 and FIG. 12 are diagrams that show the drive waveforms of the PDP device in the fifth embodiment, wherein FIG. 11 shows the drive waveforms in odd-numbered fields and FIG. 12 shows the drive waveforms in even-numbered fields. In the fifth embodiment, the drive waveforms in the second embodiment are applied to the ALIS method, therefore the voltages or the like are the same as the second embodiment but, because of the ALIS method, there are differences as follows. In the ALIS method in the fifth embodiment, the address period is divided into the first half and the second half. For example, addressing is performed in the first, the fifth, the ninth, . . . display lines during the first half and in the third, the seventh, the eleventh, . . . display lines during the second half in the odd-numbered fields shown in FIG. 12, similar to Japanese Patent No. 2801893. The fifth embodiment differs in that the charge form period TM is divided into the first half and the second half, and charges are formed in the display cells of the first, fifth, ninth, . . . display lines during the first half, and in the display cells of the third, seventh, eleventh, . . . display lines during the second half. Then a voltage, which will not cause an erroneous discharge to occur on the side where charges are not formed, is applied. In FIG. 12, for example, Vu is applied to odd-numbered X electrodes, −Vs is applied to odd-numbered X electrodes and even-numbered Y electrodes, and Vs is applied to even-numbered X electrodes during the first half of the charge form period TM to prevent an erroneous discharge from occurring between an odd-numbered Y electrode and an even-numbered X electrode, between an even-numbered X electrode and an even-numbered Y electrode, and between an even-numbered Y electrode and an odd-numbered X electrode, even if a discharge is caused to occur between an odd-numbered X electrode and an odd-numbered Y electrode. Similarly, during the second half of the charge form period TM, Vu is applied to even-numbered Y electrodes, −Vs is applied to even-numbered X electrodes and odd-numbered Y electrodes, and Vs is applied to odd-numbered X electrodes to prevent an erroneous discharge from occurring in other display lines, even if a discharge is caused to occur between an even-numbered X electrode and an even-numbered Y electrode.

In the even-numbered fields, a display line is formed between an odd-numbered Y electrode and an even-numbered X electrode and between an even-numbered Y electrode and an odd-numbered X electrode, and drive waveforms shown in FIG. 12 are applied. No detailed description is given here.

Figure 13:
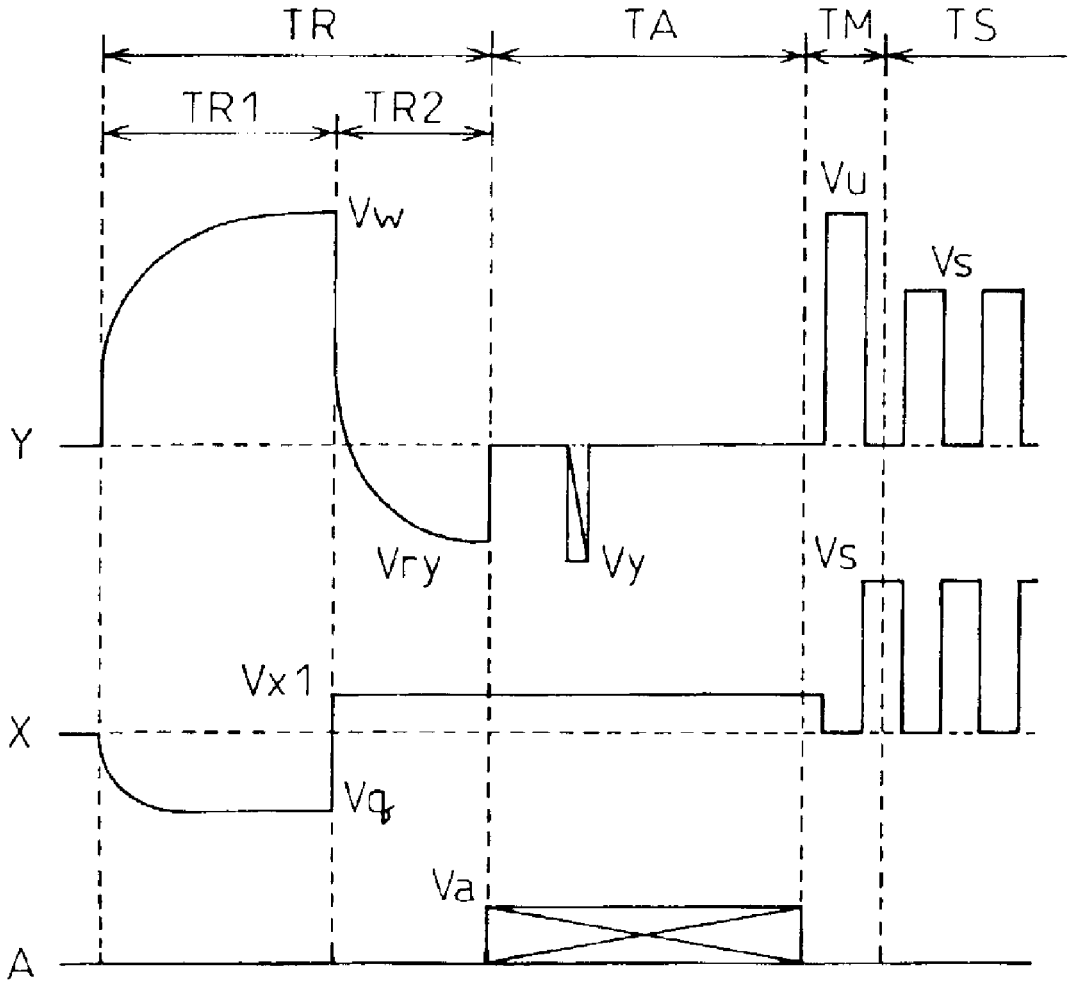
FIG. 13 is a diagram that shows drive waveforms in a PDP device in a sixth embodiment of the present invention.
Figure 14:
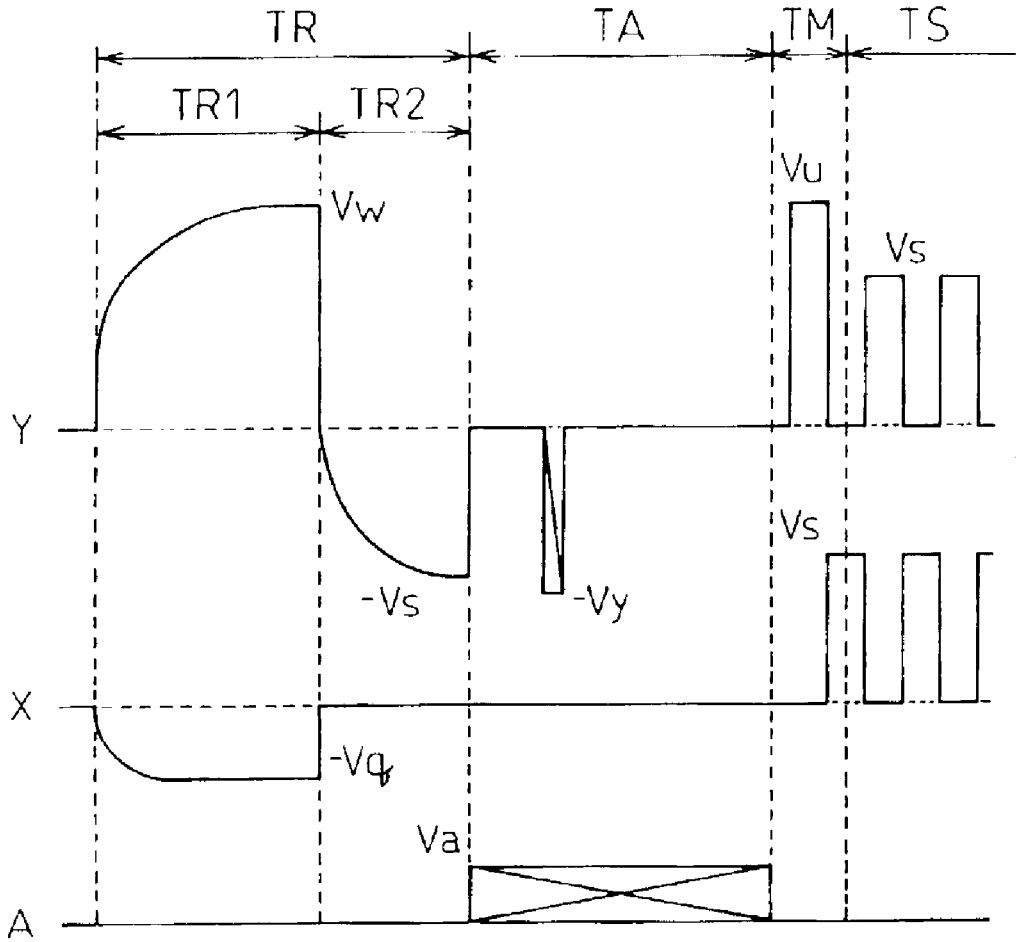
FIG. 14 is a diagram that shows drive waveforms in a PDP device in a seventh embodiment of the present invention.

The plasma display device in the sixth embodiment of the present invention has a structure similar to the conventional one shown in FIG. 1, similar to the first embodiment, but with a different drive method. FIG. 13 is a diagram that shows the drive waveforms in the sixth embodiment of the present invention. Although the sustain discharge pulse in the first embodiment is composed of positive and negative pulses to be applied to the display electrode, whose absolute value of voltage is the same, the sustain discharge pulse in the sixth embodiment is a pulse the voltage of which varies between the positive voltage Vs and the ground.

In FIG. 13, for example, Vs=160V, Vy=−115V, Vry=−100V, Vx1=60V, Vu=220V, Vw=240V, Vq=−80V and Va=60V, but there can be some variation in voltage. As the functions and the effects are almost the same as the first embodiment, no description is given here.

The plasma display device in the seventh embodiment is the same as that in the sixth embodiment except for Vx1=0V and Vry=−Vs, and the other voltages are accordingly the same, that is, Vs=160V, Vy=−175V, Vu=220V, Vw=240V, Vq=−80V and Va=60V. In this case also, there can be some variations in voltage and the functions and effects almost the same as those in the sixth embodiment can be obtained, but the cost of the power supply can be reduced because the number of kinds of power supply voltage can be reduced.

Figure 15:
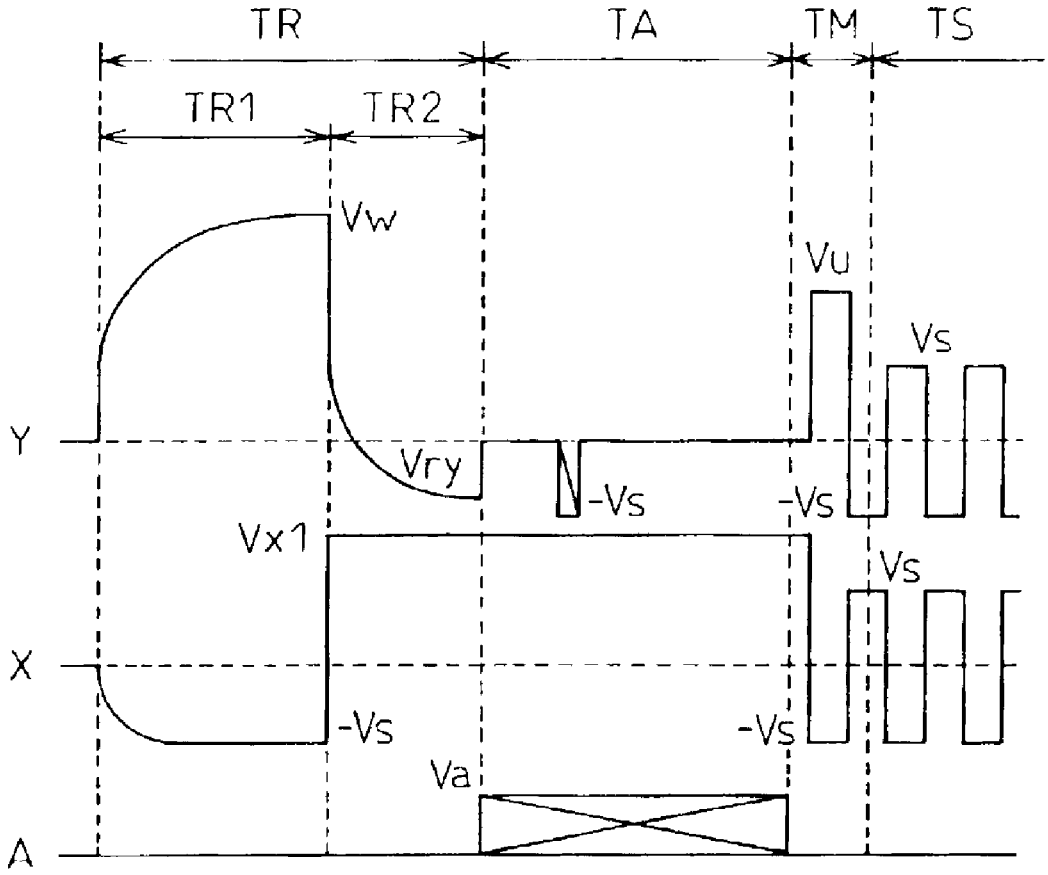
FIG. 15 is a diagram that shows drive waveforms in a PDP device in an eighth embodiment of the present invention.

FIG. 15 is a diagram that shows the drive waveforms in the eighth embodiment of the present invention. The plasma display device in the eighth embodiment differs from that in the first embodiment in that Vx1 is made to be greater than Vs. In other words, Vx1−Vry≧2Vs. As the functions and effects are almost the same as the first embodiment, no description is given here.

Figure 16:
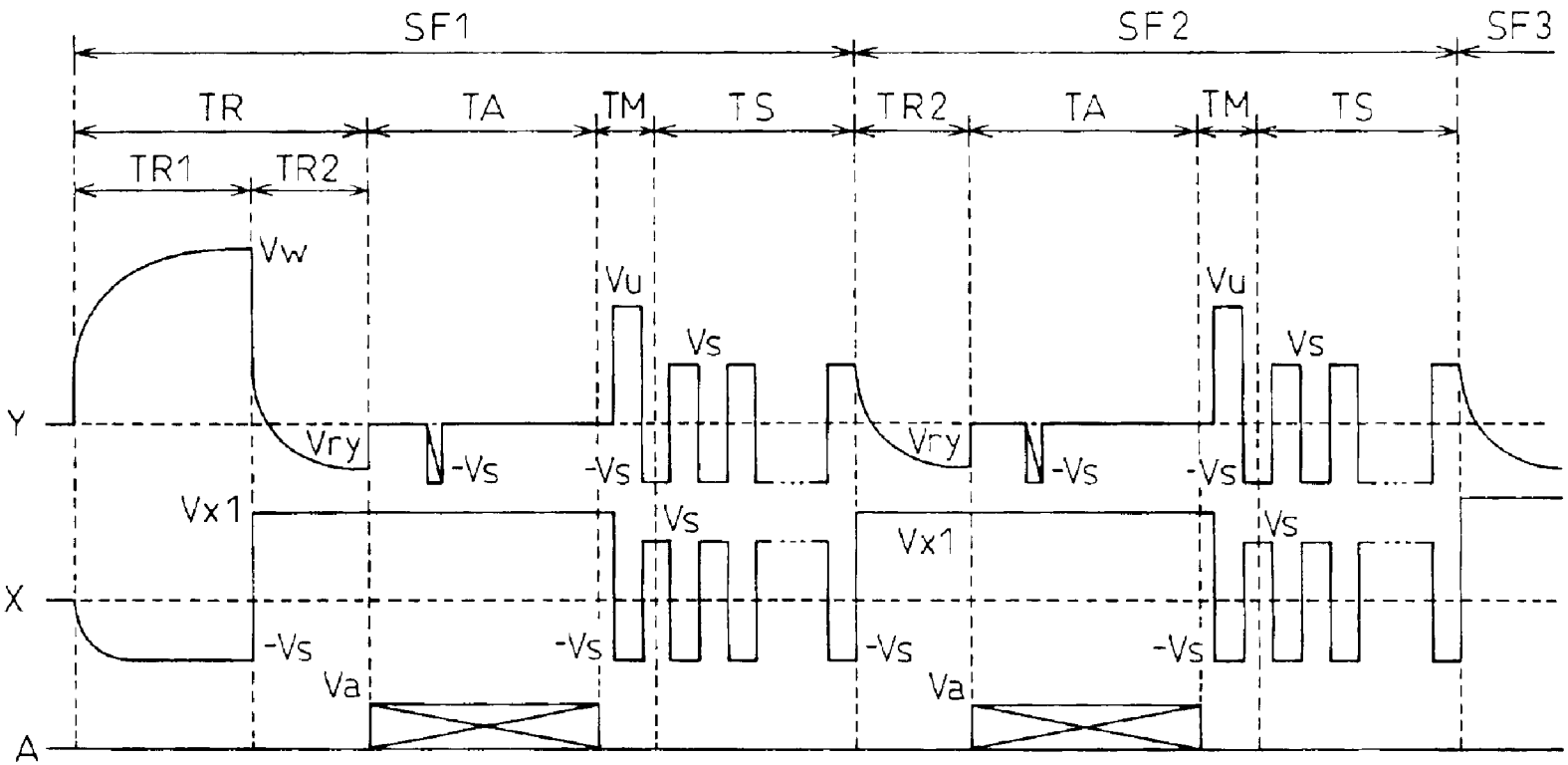
FIG. 16 is a diagram that shows drive waveform in a PDP device in a ninth embodiment of the present invention.

FIG. 16 is a diagram that shows the drive waveforms in the ninth embodiment of the present invention. In the plasma display device in the ninth embodiment, only in the first subfield SF1 of the subfields that make up a display frame, the drive waveforms in the first embodiment are used and in the second subfield SF2 and the following subfields, the charge adjust period TR2, the address period TA, the charge adjust period TM and the sustain discharge period TS are provided with the exception of the charge write period TR1 of the reset period. The sustain discharge period TS in SF1 ends with a state in which Vs is applied to the Y electrode and −Vs is applied to the X electrode. The voltage conditions in SF1, SF2 and the following subfields are the same as those in the first embodiment. In the ninth embodiment, as the number of times of the charge write periods TR1 in a display frame is reduced and the light emission due to the all-out write is reduced accordingly, the contrast can be further improved. Although the charge write period TR1 is provided only in SF1 in the present embodiment, it is possible to provide the charge write period TR1 in subfields such as one that is heavily weighted.

As described above, according to the present invention, a PDP device that can reduce the background luminance and has a high quality in contrast can be realized without the necessity to increase number of power supply circuits.

We claim:

1. A method for driving a plasma display panel consisting of plural display electrodes forming pairs of electrodes for a sustain discharge, plural address electrodes arranged so as to intersect the pairs of electrodes, and display cells formed at the intersections of the pairs of electrodes and the address electrodes, comprising:

an initialization period during which the display cells are initialized;

an address period during which an address discharge is caused to occur according to display data of each display cell so that each display cell is put into a state in accordance with the display data;

a charge form period during which a charge form pulse is applied to the pair of electrodes; and a sustain discharge period during which a sustain pulse and that with the opposite polarity are applied alternately to the pair of electrode so as to cause a sustain discharge light emission to occur, wherein the initialization period comprises a write period during which first amount of charges is accumulated in the display cells and a charge adjust period during which the first amount of charges accumulated during the write period is adjusted to second amount of charges, wherein the voltage to be applied to the pair of electrode during the charge adjust period is an inclined wave-shaped charge adjust pulse, the voltage of which varies gradually, and wherein the absolute value of voltage of the charge form pulse is greater than the absolute value of voltage of the sustain discharge pulse.

2. A method for driving a plasma display panel, as set forth in claim 1, wherein the final voltage of the charge adjust pulse to be applied to the pair of electrodes is greater than the voltage of the sustain discharge pulse of the same polarity.

3. A method for driving a plasma display panel, as set forth in claim 1, wherein the final voltage of the charge adjust pulse to be applied to the pair of electrodes is almost equal to the voltage of the sustain discharge pulse of the same polarity.

4. A method for driving a plasma display panel, as set forth in claim 1, wherein the charge adjust period comprises a first charge adjust period during which a first charge adjust pulse having an inclined wave-shape is applied to the pair of electrodes and a second charge adjust period during which a second charge adjust pulse having an inclined wave-shape is applied to the pair of electrodes, and wherein the final voltage of the first charge adjust pulse is less than the final voltage of the second charge adjust pulse.

5. A method for driving a plasma display panel, as set forth in claim 1, wherein the absolute value of the final voltage of the charge adjust pulse to be applied to the pair of electrodes is less than that of the sustain discharge pulse of the same polarity, and wherein the charge form period comprises a period before the charge form pulse is applied, during which a pulse having an inclined wave-shaped drive waveform, the polarity of which is opposite to that of the charge form pulse, the voltage of which varies gradually, and the final voltage of which is almost the same as the absolute value of voltage of the sustain discharge pulse, is applied to the pair of electrodes.

6. A method for driving a plasma display panel, as set forth in claim 1, wherein the sustain discharge pulse is composed of pulses of positive and negative voltages to be applied to the display electrode, the absolute value of which is the same, wherein the charge form pulse is composed of pulses of positive and negative voltages to be applied to the display electrode, and wherein one of the absolute values of the positive and the negative voltages of the pulses making up the charge form pulse is almost equal to the absolute value of the sustain discharge pulse.

7. A method for driving a plasma display panel, as set forth in claim 6, wherein the absolute value of the voltage to be applied to either of the pair of electrode during the charge adjust period and the address period is almost equal to the absolute value of the sustain discharge pulse.

8. A method for driving a plasma display panel, as set forth in claim 6, wherein the absolute value of the final voltage of the charge adjust pulse to be applied to the pair of electrodes is almost equal to the absolute value of the sustain discharge pulse.

9. A method for driving a plasma display panel, as set forth in claim 6, wherein the absolute value of a scan pulse to be applied to either of the display electrodes during the address period is almost equal to the absolute value of the sustain discharge pulse.

10. A method for driving a plasma display panel, as set forth in claim 1, wherein the sustain discharge pulse is composed of pulses of positive and negative voltages to be applied to the display electrodes, the absolute value of which is the same, wherein the scan pulse to be applied to either of the display electrodes during the address period has the negative voltage of the sustain discharge pulse, and wherein the charge adjust pulse is composed of an adjust pulse of negative voltage to be applied to either of the display electrodes and an adjust pulse of positive voltage to be applied to the other of the display electrodes, the voltage of the adjust pulse of negative voltage is greater than the negative voltage of the sustain discharge pulse by 5 to 30V, and the voltage of the adjust pulse of positive voltage is greater than the positive voltage of the sustain discharge pulse by 5 to 30V.

11. A method for driving a plasma display panel, as set forth in claim 1, wherein the absolute value of the voltage to be applied to either of the pair of electrodes during the charge adjust period and the address period is almost equal to the absolute value of the sustain discharge pulse.

12. A method for driving a plasma display panel, as set forth in any of claims 1 to 11, wherein a display frame is composed of plural subfields, wherein each subfield comprises the initialization period, the address period, the charge form period and the sustain discharge period, wherein the initialization period of some of the subfields comprises the write period and the charge adjust period, and wherein the initialization period of the other subfields comprises only the charge adjust period.

13. A plasma display device employing any of the driving methods set forth in any of claims 1 to 12.

* * * * *

UNITED STATES PATENT AND TRADEMARK OFFICE

CERTIFICATE OF CORRECTION

PATENT NO. : 6,940,475 B2
APPLICATION NO. : 10/404112
DATED : September 6, 2005
INVENTOR(S) : Takashi Shiizaki et al.

It is certified that error appears in the above-identified patent and that said Letters Patent is hereby corrected as shown below:

Column 14, Line 2, delete "any of claims 1 to 11," and insert - - claim 1, - - therefor.
Column 14, Line 13, delete "any of claims 1 to 12" and insert - - claim 1. - - therefor.

Signed and Sealed this

Twenty-ninth Day of August, 2006

JON W. DUDAS
*Director of the United States Patent and Trademark Office*